United States Patent [19]

Larrabee et al.

[11] Patent Number: 4,834,171

[45] Date of Patent: May 30, 1989

[54] RADIATOR AND OIL COOLER

[75] Inventors: Scott R. Larrabee; Norman F. Costello, both of Racine, Wis.

[73] Assignee: Modine Manufacturing Company, Racine, Wis.

[21] Appl. No.: 225,612

[22] Filed: Jul. 26, 1988

Related U.S. Application Data

[63] Continuation of Ser. No. 28,190, Mar. 19, 1987, abandoned.

[51] Int. Cl.[4] ..... F01P 11/08

[52] U.S. Cl. ..... 165/140; 165/169; 165/916; 123/41.33; 123/196 AB

[58] Field of Search ..... 165/140, 141, 168, 169, 165/153, 916; 123/196 AB, 41.33

[56] References Cited

U.S. PATENT DOCUMENTS

| | | | |
|---|---|---|---|
| 1,948,929 | 2/1934 | MacPherson | 184/6 |
| 2,008,164 | 7/1935 | Wolf | 165/51 |
| 2,013,708 | 9/1935 | Bianchi et al. | 165/51 |
| 2,264,820 | 12/1941 | Young | 165/82 |
| 2,325,729 | 8/1943 | Allin | 180/53 |
| 2,505,790 | 5/1950 | Panthofer | 165/140 |
| 3,116,541 | 1/1964 | Nickol et al. | 29/157.3 |
| 3,263,748 | 8/1966 | Jemal et al. | 165/140 |
| 3,265,126 | 8/1966 | Donaldson | 165/140 |
| 4,569,390 | 2/1986 | Knowlton et al. | 165/153 |

*Primary Examiner*—Ira S. Lazarus
*Assistant Examiner*—Richard R. Cole
*Attorney, Agent, or Firm*—Wood, Dalton, Phillips, Mason & Rowe

[57] ABSTRACT

A combination radiator and oil cooler including a elongated tubular header 10 having a generally cylindrical cross section with an interior 14 defining a liquid side and an exterior 22 defining an air side. A plurality of elongated parallel tubes 12 are joined to the header 10 at one side thereof and fins 16 extended between the tubes 12. A saddle element 24 is disposed on the header 10 oppositely of the tubes 12 and has a periphery 28, 56, joined to the exterior 22 and an internal section 30, 58, bounded by the periphery 28, 56 and spaced from the exterior 22 to define an oil space 32, 60. An inlet fixture 34 and an outlet fixture 36 are secured to the saddle element 24 oppositely of the space 26, 60 and within the periphery 28, 56 in fluid communication with the oil space 26, 60.

4 Claims, 1 Drawing Sheet

RADIATOR AND OIL COOLER

This is a continuation of Ser. No. 28,190 filed Mar. 19, 1987 which is now abandoned.

FIELD OF THE INVENTION

This invention relates to vehicular radiators, and more particularly, to vehicular radiators that include provision for oil cooling, such as cooling of transmission oil.

BACKGROUND OF THE INVENTION

Over the years, there have been a large number of proposals of various sorts of combination radiators and oil coolers. Initially, the constructions were proposed to provide a means for cooling engine lubricating oil but more recently, they tend to be employed for cooling transmission oil or hydraulic fluid.

In some cases, certain of the tubes in the radiator were segregated as by partitions to provide a separate heat exchanger to which oil would be flowed for cooling purposes. This approach is shown, for example, in U.S. Pat. No. 2,013,708 issued Sept. 10, 1935 to Bianchi et al.

In other instances, separate oil cooling cells were simply aded on to existing radiator cells by any suitable form of conventional securement. An example of this approach was found in U.S. Pat. No. 2,505,790 issued May 2, 1950 to Panthofer.

In both of the foregoing approaches, air was utilized as the cooling media for the oil, heat being transferred via tubes and fins from the oil to air passing through the heat exchanger.

Another sort of approach has also been employed. According to this approach, the oil is flowed in heat exchange relation to engine coolant and rejects heat to the coolant, which then rejects heat to the air. Examples to this approach are found in U.S. Pat. Nos. 3,116,541 issued Jan. 7, 1964 to Nickol et al and 3,265,126 issued Aug. 9, 1966 to Donaldson.

Of the two, the Nickol approach seems preferable since the oil cooling heat exchanger components are simply piggy-backed on to an existing header for a vehicular radiator although the header requires some modification to accept the oil cooler components.

Though in theory the Nickol approach works well, it is not without attendant difficulties. For one thing, the capacity of the unit is limited by structural constraints related to the header. For another, components are not particularly easy to hold in partially assembled relation during a final assembly process.

The present invention is directed to overcoming one or more of the above problems.

SUMMARY OF THE INVENTION

It is the principal object of the invention to provide a new and improved combination radiator and oil cooler. More particularly, it is an object of the invention to provide a new and improved combination radiator and oil cooler of the sort wherein a saddle element or the like is mounted to a radiator header to define an oil cooler.

An examplary embodiment of the invention achieves the foregoing object in a construction including at least one elongated tubular header having a cross section in the form of a closed curve with its exterior defining an air side and the interior defining a liquid side. A plurality of elongated parallel tubes are joined to the header at one side thereof and are in fluid communication with the interior. Fins extend between the tubes and a saddle element is located on the header oppositely of such one side. The saddle element has a periphery joined to the exterior and and internal section bounded by the periphery and spaced from the exterior to define an oil space. An inlet fixture and an outlet fixture are secured to the saddle element oppositely of the space and within the periphery and in fluid communication with the oil space.

According to the invention, the oil space volume may be increased over prior art constructions to thereby increase capacity. Moreover, the fitting of the saddle element to the header can be accomplished in such a way as to partially join the same during initial stages of the assembly to ease assembly operations.

In one embodiment of the invention, the internal section of the saddle element is displaced from the periphery and away from the exterior such that the oil space is formed in the saddle element.

According to another embodiment of the invention, the header exterior is provided with a recess oppositely of the one side receiving the tubes. The recess is aligned with the internal section of the saddle element so as to, together therewith, define an oil space.

In a highly preferred embodiment of the invention, opposite edges of the periphery saddle element are in close proximity to the tubes. Thus, during assembly, the tubes serve to pilot the saddle element as it is axially moved on to the tubular header. This simplifies the assembly process.

The invention further contemplates that the cross section of the tubular header be cylindrical. The saddle element is partially circular in cross section so as to mate with the cylindrical header and has an arc length in excess of 180°. This feature of the invention serves to maximize capacity as well as to act to hold the elements together in early stages of assembly.

In the alternative embodiment of the invention, the saddle element is circular in cross section so as to envelop the cylindrical header. This feature of the invention serves to facilitate manufacture thereof.

Other objects and advantages will become apparent from the following specification taken in connection with the accompanying drawings.

DESCRIPTION OF THE PREFERRED EMBODIMENTS

Figure 1:
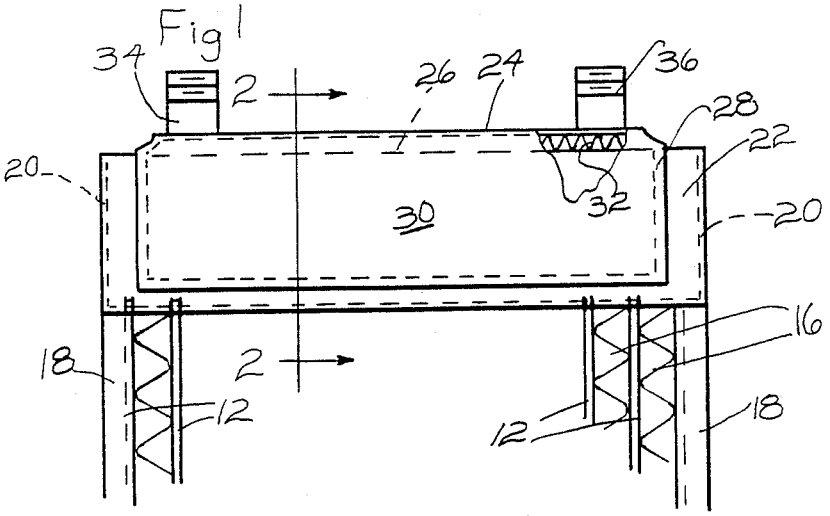
FIG. 1 is a fragmentary elevational view of a combination radiator and oil cooler made according to the invention with parts broken away for clarity.
Figure 2:
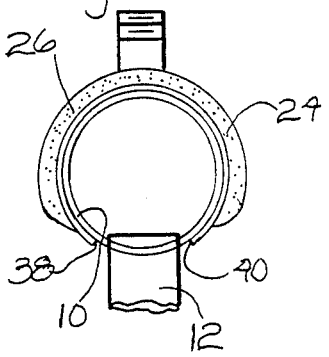
FIG. 2 is a sectional view taken approximately along the line 2—2 in FIG. 1.

One embodiment of a combination radiator and oil cooler made according to the invention is illustrated in FIGS. 1 and 2 and with reference thereto, is seen to include an elongated, tubular header 10 formed of any suitable material. Typically, the header 10 will be formed of metal but highly heat conductive plastics could be used in lieu thereof.

One side of the header 10 is punched with holes to receive the ends of elongated, flattened tubes 12 of conventional construction. The tubes 12 are sealed to the header 10 and in fluid communication with the interior 14 of the header 10 which is, of course, the liquid side of the radiator thus defined. Serpentine fins 16 extend between adjacent ones of the tubes 12 as well as end pieces 18. The ends pieces serve to interconnect the header 10 to another header (not shown) as is well known.

The ends of the tubular header 10 may be closed by any suitable form of end cap 20 as desired.

The exterior 22 of the tubular header 10 is on the air side of the heat exchanger and receives a saddle element 24 which, together with the air side 22, defines an interior oil space 26 through which oil to be cooled may be flowed. In the embodiment illustrated in FIGS. 1 and 2, the saddle element 24 has a periphery 28 which is bonded to the air side 22 of the header 10 by any suitable means. An internal section 30 of the saddle element 24, that is, the remainder of the saddle element 24 within the periphery 28 is displaced therefrom in a direction away from the air side 22 and the tubes 12 to raise the same and provide the oil space 26.

If desired, any suitable form of turbulator 32 may be located in the space as desired. One form of suitable turbulator is shown in the previously identified Nickol patent.

The assembly is basically completed by the provision of an inlet fixture 34 and an outlet fixture 36 on the internal section 30 of the saddle element 24 and in fluid communication with the space 26.

One particular feature of the invention resides in the fact that the arcuate extent of the saddle element 24 is in excess of 180° and may approach 270°. This brings opposite edges 38 and 40 of the saddle element 24 into close proximity with the ends of the tubes 12 as they are received within the header 10. As a consequence of this construction, when the radiator is partially assembled, and it is desired to axially slide the saddle element 24 onto the header 10, the tubes 12 together with the edges 38 and 40 serve to pilot movement of the saddle element 24 into the proper location. Another feature results from the large arcuate extent of the saddle element 24. In particular, the larger the arcuate extent, the greater the volume of the space 26 thereby increasing the capacity of the oil side of the overall heat exchanger and providing an increased heat transfer area across part of the header 10 opposite the side receiving the tubes 12.

Figure 3:
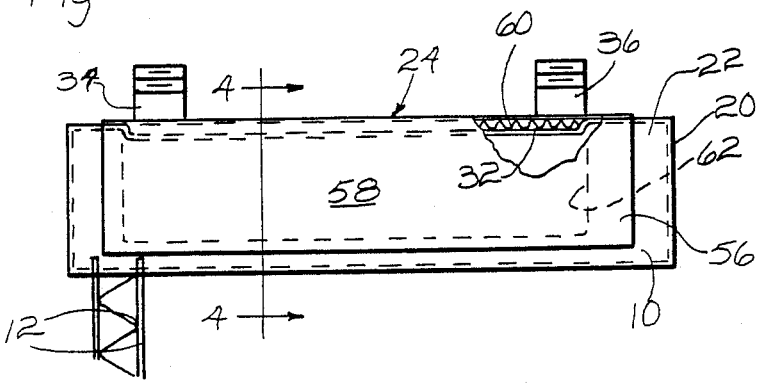
FIG. 3 is a view similar to FIG. 1 but of a modified embodiment of the invention.
Figure 4:
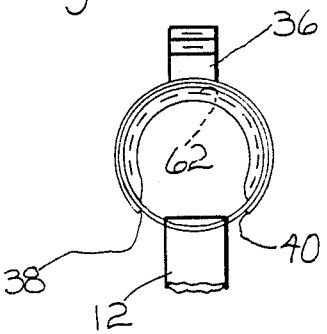
FIG. 4 is a sectional view taken approximately along the lines 4—4 in FIG. 3.

A modified embodiment of the invention is illustrated in FIGS. 3 and 4 and where identical components are utilized, in the interest of brevity, they will not be described and will be given the same reference numerals.

In this embodiment of the invention, the saddle element has a periphery shown at 56 and an internal section shown at 58 and the two are co-extensive with each other, that is, one is not displaced from the other as is the case with the embodiment illustrated in FIGS. 1 and 2. The saddle element 24 of this embodiment accordingly may be of cylindrical and mating shape to the air side 22 of the header 10.

To provide an oil receiving space which is shown at 60, a recess 62 is formed in the air side 22 of the header 10 opposite from the side receiving the tubes 12. Again, a turbulator may be utilized if desired. Suitable bonds are formed around the entire periphery 56 to bond the same in sealing relation to the air side 22 of the tube 12.

It will be observed that the embodiment of FIGS. 3 and 4, like the embodiment of FIGS. 1 and 2, utilizes edges 38 and 40 of the saddle element 24 that are in close proximity to the leading and trailing edges of the tubes 12, again for piloting purposes during assembly.

Figure 5:
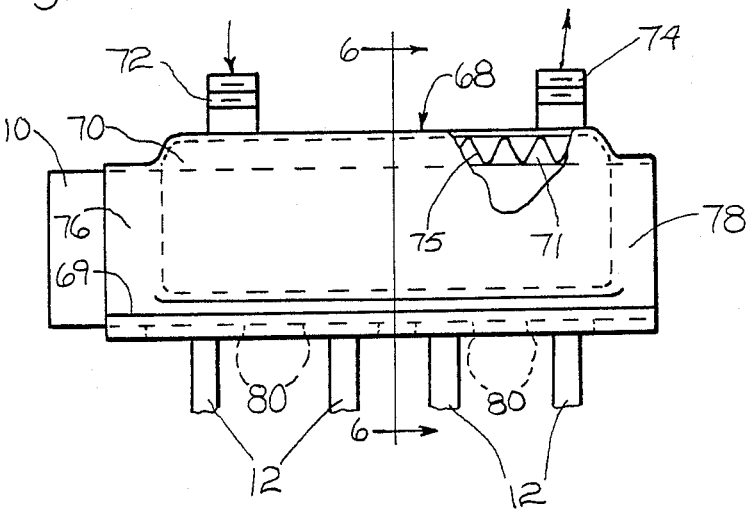
FIG. 5 is a view similar to FIGS. 1 and 3 but of still another alternative embodiment of the invention.
Figure 6:
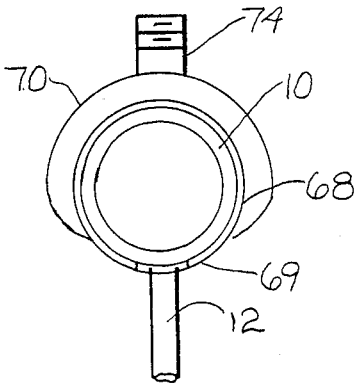
FIG. 6 is a sectional view taken approximately along the lines 6—6 in FIG. 5.

FIGS. 5 and 6 illustrate a further alternative embodiment of the invention. In the embodiment of FIGS. 5 and 6, a saddle element, generally designated 68, is formed of a welded tube. The weld seam 69 may be at any desired location but typically will be at a location whereat the tube is not deformed.

Prior to forming the weld 69, a pocket 70 is displaced from the remainder of the tube so as to define, together with the air side 22 of the header 10, an interior oil space 71 much like the space 26 (FIGS. 1 and 2) through which oil to be cooled may be flowed. Nipples 72 and 74 may be in fluid communication with the interior oil space 71 to provide an inlet and an outlet for the oil flow path respectively. In addition, any suitable form of a turbulator 75 may be disposed within the oil space 71.

The tube 68 of which the saddle is formed has ends 76 and 78 flanking the pocket 70 and which have inner diameters approximately equal to the outer diameter of the header 10. This relationship may be accomplished by suitably preforming the ends 76 and 78 prior to the application of the saddle 70 to the header 10 but more frequently, it may be accomplished by swaging the ends 76 and 78 with the saddle 68 on the header 10 to achieve the desired fit. The interface of the ends 76 and 78 with the header 10 may be sealed in any suitable fashion such as by soldering, brazing or welding.

Oppositely of the pocket 70, the saddle 68 includes a plurality of slots 80 spaced so as to receive tubes such as the tubes 12. Thus, the tubes 12 may extend into openings in the header 10 to establish immediate fluid communication with the interior thereof. In some instances, the slots 80 will be simultaneously formed with the holes in the header 10.

It is to be understood that the invention comprehends numerous ways of joining the saddle element to a header including, but not limited to, swaging both ends of the saddle element or various combinations of swaging the saddle element and flaring the header, such as flaring one end of the header so as to join with the saddle element while swaging the opposing end of the saddle element to the header and various combinations of partially flaring the header and partially swaging the saddle element.

The embodiment illustrated in FIGS. 5 and 6, wherein the saddle element 68 envelops the header 10, may facilitate manufacturing by simplifying the production of the shell element and eliminating bare fixturing.

It will therefore be appreciated that a combination radiator and oil cooler made according to the invention has increased capacity over that provided by prior art as represented by Nickol and further, is adapted to be more easily assembled as stated previously.

What is claimed is:

1. A combination radiator and oil cooler comprising:

at least one elongated tubular header having a cross section in the form of a closed curve, the exterior defining an air side and the interior defining a liquid side;

a plurality of elongated parallel tubes joined to said header at one side thereof and being in fluid communication with said interior;

fins extending between said tubes;

a saddle element on said header oppositely of said one side and having a periphery joined to said exterior and an internal section bounded by said periphery and spaced from said exterior to define an oil space, wherein said saddle element being in the form of a tube telescoped on said header, that part of said saddle element tube adjacent said header one side being in substantial abutment with said header along the length thereof; and an inlet fixture and an outlet fixture secured to said saddle element oppositely of said space and within said periphery and in fluid communication with said oil space.

2. A combination radiator and oil cooler comprising:

at least one elongated tubular header having a generally cylindrical cross section, the exterior defining an air side and the interior defining a liquid side;

a tubular saddle element telescoped on said header and having a periphery extending completely around and joined to said exterior and an internal section bounded by said periphery and spaced from said exterior to define an oil space;

one side of said tubular saddle element opposite said space being in substantial abutment with said header along the length thereof;

a plurality of spaced holes in said one side of said tubular saddle element;

a plurality of elongated parallel tubes, one for each hole, extending through an associated hole to be joined to said header in fluid communication with said interior;

fins extending between said tubes in heat transfer relation thereto; and spaced fixtures secured to said saddle element and each in fluid communication with said oil space to define an oil inlet to said space and an oil outlet from said space.

3. The combination radiator and oil cooler of claim 2 wherein said space is defined by an outwardly opening recess in said header.

4. The combination radiator and oil cooler of claim 2 wherein said space is defined by an inwardly opening recess in said tubular saddle element and facing said holes.

* * * * *